US010156819B2

(12) United States Patent
Abe et al.

(10) Patent No.: US 10,156,819 B2
(45) Date of Patent: Dec. 18, 2018

(54) IMAGE FORMING APPARATUS WITH HEATING DEVICE FOR CONTROLLING POROSITY OF TONER IMAGE

(71) Applicant: FUJI XEROX CO., LTD., Tokyo (JP)

(72) Inventors: Masaaki Abe, Kanagawa (JP); Nobuhiro Katsuta, Kanagawa (JP); Yasufumi Suwabe, Kanagawa (JP); Satoshi Tatsuura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/720,276

(22) Filed: Sep. 29, 2017

(65) Prior Publication Data

US 2018/0095387 A1 Apr. 5, 2018

(30) Foreign Application Priority Data

Oct. 5, 2016 (JP) ..... 2016-197424

(51) Int. Cl.
*G03G 15/20* (2006.01)
*G03G 15/00* (2006.01)
*G03G 15/11* (2006.01)

(52) U.S. Cl.
CPC ..... *G03G 15/2007* (2013.01); *G03G 15/11* (2013.01); *G03G 15/657* (2013.01)

(58) Field of Classification Search
CPC .. G03G 15/11; G03G 15/2007; G03G 15/657; G03G 21/0088
See application file for complete search history.

(56) References Cited

U.S. PATENT DOCUMENTS 9,158,244 B1 10/2015 Tatsuura
9,310,721 B2 4/2016 Yokoyama
2010/0086336 A1* 4/2010 Izawa ..... G03G 15/2007 399/336
2014/0321892 A1* 10/2014 Hirayama ..... G03G 15/11 399/328
2015/0016852 A1* 1/2015 Katsuta ..... G03G 15/11 399/320
2015/0268604 A1* 9/2015 Kawahata ..... G03G 15/2007 399/328

FOREIGN PATENT DOCUMENTS

JP 2003-307995 A 10/2003
JP 2011-070077 A 4/2011
JP 2015-184317 A 10/2015

* cited by examiner

*Primary Examiner* — Sophia S Chen
(74) *Attorney, Agent, or Firm* — Oliff PLC

(57) ABSTRACT

An image forming apparatus includes a fixing device that fixes a toner image which is developed with a liquid developer containing a toner and a volatile carrier oil on a recording medium, a heating device that is disposed on an upstream side of the fixing device in a feed direction of the recording medium, and heats the toner image on the recording medium in a non-contact manner, in which heating is controlled such that a porosity of the toner image on the recording medium in an outlet of the heating device is in a range of 20% by volume to 40% by volume, and a drying path that is disposed between the heating device and the fixing device in the feed direction of the recording medium, and dries the recording medium by evaporating the carrier oil in the recording medium.

20 Claims, 6 Drawing Sheets

| TONER LAYER |  |  |  |  |
|---|---|---|---|---|
| POROSITY | 50 vol.% | 40 vol.% | 20 vol.% | 10 vol.% |
| DRYING PROPERTIES | A A | A A | A A | B B |
| OFFSET | B B | A A | A A | A A |

IMAGE FORMING APPARATUS WITH HEATING DEVICE FOR CONTROLLING POROSITY OF TONER IMAGE

CROSS-REFERENCE TO RELATED APPLICATIONS

This application is based on and claims priority under 35 USC 119 from Japanese Patent Application No. 2016-197424 filed Oct. 5, 2016.

BACKGROUND

Technical Field

The present invention relates to an image forming apparatus.

SUMMARY

According to an aspect of the invention, there is provided an image forming apparatus including:

a fixing device that fixes a toner image which is developed with a liquid developer containing a toner and a volatile carrier oil on a recording medium;

a heating device that is disposed on an upstream side of the fixing device in a feed direction of the recording medium, and heats the toner image on the recording medium in a non-contact manner, in which heating is controlled such that a porosity of the toner image on the recording medium in an outlet of the heating device is in a range of 20% by volume to 40% by volume; and a drying path that is disposed between the heating device and the fixing device in the feed direction of the recording medium, and dries the recording medium by evaporating the carrier oil in the recording medium.

BRIEF DESCRIPTION OF THE DRAWINGS

Exemplary embodiments of the present invention will be described in detail based on the following figures, wherein.

DETAILED DESCRIPTION

The exemplary embodiment will be described below with reference to the drawings. In this specification, when there is a numerical range expressed using "to", the numerical range means a range including numerical values described before and after "to" as a lower limit value and an upper limit value.

First Embodiment

Entire Components of Image Forming Apparatus

Figure 1:
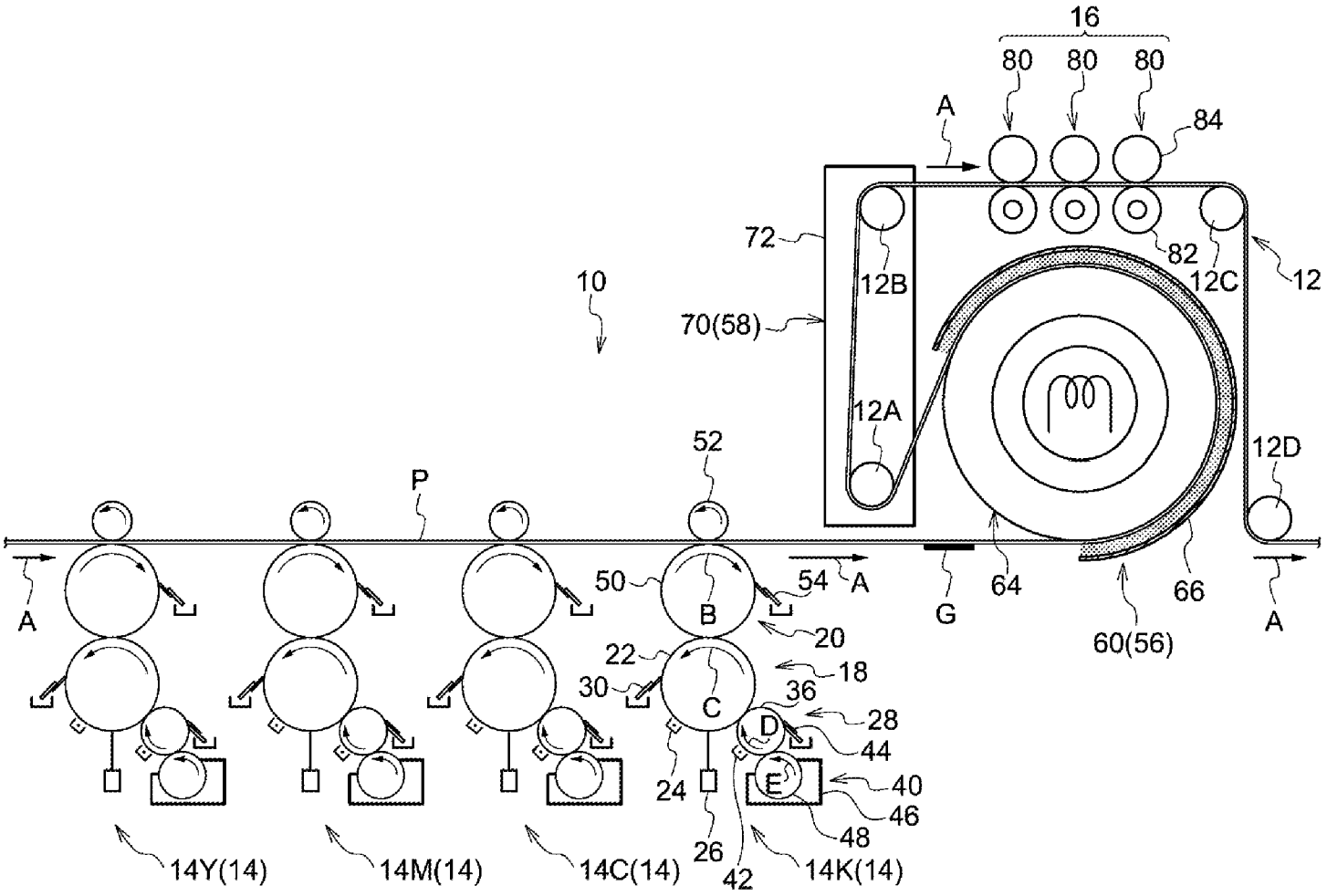
FIG. 1 is a configuration diagram illustrating an image forming apparatus according to a first exemplary embodiment.

FIG. 1 illustrates an example of an image forming apparatus 10 of the first exemplary embodiment. As illustrated in FIG. 1, the image forming apparatus 10 is provided with a feeding unit 12 that supplies continuous paper P as an example of a recording medium. In addition, the image forming apparatus 10 is provided with an image forming unit 14 that forms a toner image on the continuous paper P, a pre-fixing heating unit 56 that heats the toner image formed on the continuous paper P, a pre-fixing drying unit 58 that dries the toner image formed on the continuous paper P, and a fixing unit 16 that fixes the toner image on the continuous paper P in order from the upstream side of a feed direction of the continuous paper P supplied from the feeding unit 12. Here, the toner image is an example of an image provided by toner.

The feeding unit 12 has a function of supplying the continuous paper P in an arrow A direction (feed direction) at a predetermined feeding speed. Although not shown, the feeding unit 12 is provided with a sending roller which is disposed on most upstream side in the feed direction of the continuous paper P and feeds the continuous paper P, and a winding roller which is disposed on the most downstream side in the feed direction of the continuous paper P and winds continuous paper P. Further, the feeding unit 12 is provided with plural feeding rollers 12A, 12B, 12C, and 12D each of which is disposed at a position where the feed direction of the continuous paper P is changed, on the downstream side of the pre-fixing heating unit 56.

The image forming unit 14 is provided with an image forming unit 14Y that forms a yellow (Y) toner image, an image forming unit 14M that forms a magenta (M) toner image, an image forming unit 14C that forms a cyan (C) toner image, and an image forming unit 14K that forms a black (K) toner image. In the image forming apparatus 10, as an example, the image forming units 14Y, 14M, 14C, and 14K are disposed from the upstream side of the feed direction of the continuous paper P.

The respective color image forming units 14Y, 14M, 14C, and 14K basically have the same configuration except for a liquid developer to be used. Each of the color image forming units 14Y, 14M, 14C, and 14K is provided with an image forming unit 18 that forms a toner image by using a liquid developer containing toner and a carrier liquid, and a transfer unit 20 that transfers the toner image formed by the image forming unit 18 to the continuous paper P. In the exemplary embodiment, the continuous paper P is supplied in the horizontal direction by the feeding unit 12, and the respective color image forming units 14Y, 14M, 14C, and 14K are arranged toward the downstream side from the upstream side in the horizontal direction.

The image forming unit 18 is provided with an image holding member 22 which rotates in the arrow C direction and holds the toner image. In addition, the image forming unit 18 is provided with a charging device 24 that charges the image holding member 22, an exposure device 26 that forms an electrostatic latent image by irradiating the image holding member 22 with exposed light, and a developing device 28 that develops the electrostatic latent image on the image holding member 22 as a toner image, in order from the upstream side of the rotation direction (arrow C direction) of the image holding member 22. Further, the image forming unit 18 is provided with a cleaning device 30 that cleans an outer peripheral surface of the image holding member 22 after the toner image is transferred from the image holding member 22 to a transfer roller 50 described later.

The developing device 28 is provided with a developing roller 36 that rotates in an arrow D direction and develops the electrostatic latent image formed on the image holding member 22 with a liquid developer. In addition, the developing device 28 is provided with a supply device 40 that supplies the liquid developer to the developing roller 36 in order from the upstream side of the rotation direction (arrow D direction) of the developing roller 36, and a charging device 42 that charges toner contained in the liquid developer which is supplied to the developing roller 36. In addition, the developing device 28 is provided with a cleaning device 44 that cleans the outer peripheral surface of the developing roller 36 after development.

The liquid developer used in the exemplary embodiment is a liquid type developer in which toner (particles) is dispersed in a carrier liquid, and examples of the carrier liquid include an insulating liquid. In the exemplary embodiment, as the carrier liquid, for example, a volatile carrier oil selected from a vegetable oil, a liquid paraffin oil, a silicone oil, and the like may be used. Here, the volatility means a state where a flash point is less than 130° C. or a volatile content after 24 hours at 150° C. is more than 8% by weight. The flash point is measured based on JIS K2265-4 (2007). In addition, in the liquid developer, as an example, toner having a volume average particle diameter which is equal to or less than 2 μm may be used. Further, in the liquid developer, as an example, toner (particles) is dispersed in the carrier oil at a concentration of 15 wt % to 45 wt %. Here, a volume average particle diameter of the toner is measured by using COULTER COUNTER (manufactured by Beckman Coulter, TA2 type).

The supply device 40 is disposed on the lower side of the developing roller 36 and is provided with a container 46 that contains a liquid developer, and a supply roller 48 that draws up the liquid developer from the container 46 so as to supply the outer peripheral surface of the developing roller 36 with the liquid developer. The supply roller 48 rotates in an arrow E direction, and moves in the same direction as that of the developing roller 36 at a contact position with the developing roller 36. The supply roller 48 is provided with plural recessed portions (not shown) on the outer peripheral surface thereof, and has a configuration such that the liquid developer is held in the recessed portions. In addition, the supply device 40 is provided with a regulating blade (not shown) for adjusting a layer film of the liquid developer attached to the supply roller 48.

In the supply device 40, the liquid developer contained in the container 46 is drawn up by the rotation of the supply roller 48, and the layer film of the liquid developer attached by the supply roller 48 is adjusted by the regulating blade (not shown). In addition, the liquid developer attached to the supply roller 48 is supplied to the outer peripheral surface of the developing roller 36 by an electric field applied between supply roller 48 and the developing roller 36.

In the developing device 28, the toner contained in the liquid developer which is supplied to the outer peripheral surface of the developing roller 36 is charged by the charging device 42, and an electrostatic latent image on the image holding member 22 is developed as a toner image by the liquid developer of the outer peripheral surface of the developing roller 36. Note that, in a case where an electrostatic latent image is developed as a toner image by using the liquid developer, the carrier oil is also moved to the image holding member 22.

The transfer unit 20 is provided with a transfer roller 50 which is disposed opposite to the image holding member 22, rotates in the arrow B, and transfers the toner image on the image holding member 22 by the electric field applied between the transfer roller 50 and the image holding member 22. In addition, the transfer unit 20 is provided with a back-up roller 52 which is disposed on the side opposite to the transfer roller 50 with the continuous paper P interposed therebetween, and transfers the toner image on the transfer roller 50 to the continuous paper P by the electric field applied between the back-up roller and the transfer roller 50. Further, the transfer unit 20 is provided with a cleaning device 54 that cleans the outer peripheral surface of the transfer roller 50 after transfer. Here, the back-up roller 52 is an example of the transfer unit.

In the transfer unit 20, the toner image on the image holding member 22 is transferred to the transfer roller 50, and the toner image transferred to the transfer roller 50 is transferred to the continuous paper P. Note that, the carrier liquid moved from the developing roller 36 to the image holding member 22 is also moved to the continuous paper P via the transfer roller 50.

The pre-fixing heating unit 56 is provided with a heating device 60 that is disposed on the downstream side of the image forming unit 14 in the feed direction of the continuous paper P and heats the toner image on continuous paper P. In the heating device 60, the toner image is heated in a non-contact manner with the toner image on the continuous paper P. The heating device 60 will be described later.

The pre-fixing drying unit 58 is provided with a drying device 70 that is disposed on the downstream side of the heating device 60 in the feed direction of the continuous paper P and dries the toner image on the continuous paper P. Here, the pre-fixing drying unit 58 is an example of a drying path. In addition, the drying device 70 is an example of a drying member. The drying device 70 is provided at a position where the continuous paper P is wound onto two feeding rollers 12A and 12B. In the drying device 70, continuous paper P is dried by evaporating the carrier oil in the continuous paper P. The drying device 70 will be later.

The fixing unit 16 is provided at a position where the continuous paper P is wound onto two feed rollers 12B and 12C. The fixing unit 16 is provided with a fixing device 80 which is provided with a heating roller 82 and a pressurizing roller 84 that pressurize continuous paper P to the heating roller 82. In the exemplary embodiment, the fixing unit 16 is provided with three of the fixing devices 80 each of which is provided with a pair of the heating roller 82 and the pressurizing roller 84.

In the fixing device 80, when the continuous paper P passes through a nip portion between the heating roller 82 and the pressurizing roller 84, the continuous paper P is heated and pressurized, and thereby the toner image is fixed on the continuous paper P. The heating roller 82 and the pressurizing roller 84 will be described later.

In the above-described image forming apparatus 10, the image holding member 22 of each of the color image forming units 18 rotates, and the outer peripheral surface of the image holding member 22 is charged by the charging device 24. Next, the outer peripheral surface of the image holding member 22 is exposed by the exposure device 26 so as to form an electrostatic latent image on the outer peripheral surface of the image holding member 22. In addition, the electrostatic latent image is developed as a toner image by the developing device 28. In addition, the toner image which is formed on the outer peripheral surface of the rotating image holding member 22 is primarily transferred to the transfer roller 50. The toner image which is primarily transferred to the transfer roller 50 is transferred to the continuous paper P supplied in the arrow A direction. Such a step is performed in each of the color image forming units 14, and a toner image G in which colors are superimposed is formed on the continuous paper P. Here, the toner image G is an image formed with the liquid developer, and contains toner particles and the carrier oil.

Thereafter, regarding the continuous paper P to be supplied, the toner image G on continuous paper P is heated by the heating device 60 of the pre-fixing heating unit 56, and at least a portion of the carrier oil contained in the continuous paper P and the toner image G is removed by the drying device 70 of the pre-fixing drying unit 58, thereby drying the continuous paper P. Further, the toner image G is fixed on the continuous paper P by the fixing device 80 of the fixing unit 16.

Main Components of Image Forming Apparatus

Next, the main components of the image forming apparatus 10 of the first exemplary embodiment will be described.

Figure 2:
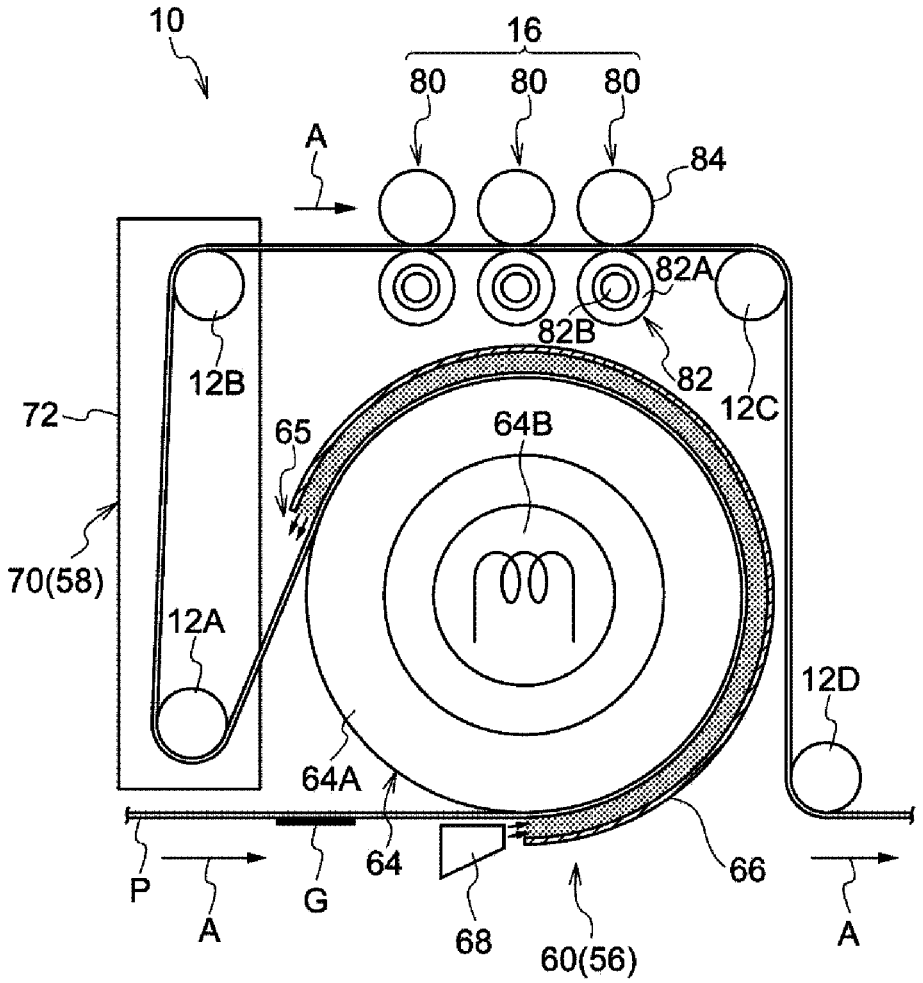
FIG. 2 is a sectional view illustrating a heating device, a drying path, and a fixing device used for the image forming apparatus as illustrated in FIG. 1.

FIG. 2 is a sectional view illustrating the pre-fixing heating unit 56, the pre-fixing drying unit 58, and the fixing unit 16 which are main components of the image forming apparatus 10 as illustrated in FIG. 1.

As illustrated in FIG. 2, the pre-fixing heating unit 56 is provided with the heating device 60 as described above. The heating device 60 is provided with a heating roller 64 which is in contact with a back surface (a surface on the side opposite to the surface on which the toner image G is formed) of the continuous paper P, and a cover 66 which is disposed so as to cover the heating roller 64 along the circumferential direction of the heating roller 64. The cover 66 is disposed at an interval from a front surface of the heating roller 64. In the exemplary embodiment, the continuous paper P is wound onto the heating roller 64 in a range of 180 degrees or more (in the exemplary embodiment, as an example, a range of 250 degrees) in the circumferential direction of the heating roller 64. The heating roller 64 rotates following the movement of the continuous paper P. The cover 66 is disposed at a position corresponding to the range in which the continuous paper P is wound onto the heating roller 64.

The heating roller 64 is provided with a substrate 64A having a cylindrical shape and a heating source 64B which is disposed in the substrate 64A. The heating source 64B is, for example, a halogen lamp. The substrate 64A is, for example, formed of metal, and examples thereof include an aluminum drum. With respect to the heating roller 64, for example, the temperature of the surface of the heating roller 64 is set in a range of 70° C. to 100° C. by the heating source 64B.

In addition, the heating device 60 is provided with a warm air heater 68 which blows warm air to a space between the heating roller 64 and the cover 66 from the upstream side of the rotation direction of the heating roller 64. The space between the heating roller 64 and the cover 66 is set as an air flow path. The warm air heater 68 is, for example, provided with an infrared lamp and a fan, and has a configuration in which warm air is blown to the space between the heating roller 64 and the cover 66 by the rotation of the fan. In addition, the warm air blown to the space between the heating roller 64 and the cover 66 flows toward the rotation direction downstream side of the heating roller 64 along the cover 66, and the warm air is discharged from an outlet 65 between the heating roller 64 and the cover 66 to the outside. In the heating device 60, a position where the continuous paper P wound onto the heating roller 64 is discharged from the cover 66 is set as an outlet 65 of the continuous paper P in heating device 60. Here, the outlet 65 of the continuous paper P in the heating device 60 is an example of the outlet of the recording medium. With respect to the warm air heater 68, for example, the warm air at 100° C. is set to be blown at a wind speed of 20 m/s.

The toner image G on continuous paper P is heated by the warm air blown from the heating source 64B and the warm air heater 68 while the continuous paper P passes through the position where the continuous paper P is wound onto the heating roller 64 facing the cover 66. In the heating device 60 of the exemplary embodiment, the heating is controlled such that the porosity of the toner of the toner image G in the outlet 65 of the continuous paper P is in a range of 20% by volume to 40% by volume by adjusting the temperature of the heating source 64B and the temperature and the air volume of the warm air. Here, the temperature of the heating source 64B and the temperature of the warm air of the warm air heater 68 is described as an example of the heating temperature of the heating device 60. Note that, in the following description, % by volume is described as "vol. %".

Figure 5:
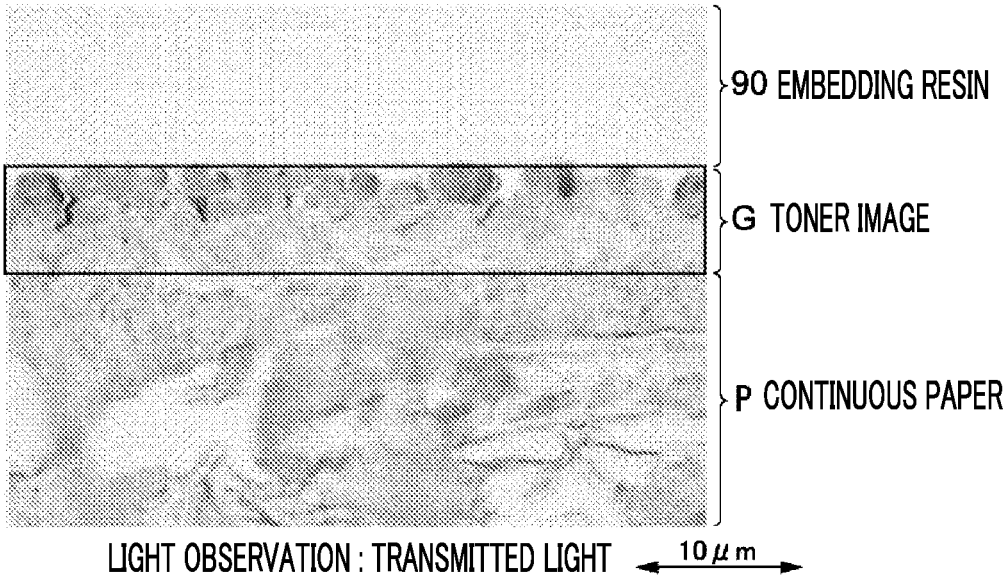
FIG. 5 is a diagram illustrating a sample for calculating a porosity of toner in a toner image on a continuous paper.

In this regard, a method of measuring the porosity will be described. As illustrated in FIG. 5, the toner image G on continuous paper P in a predetermined area is embedded by an embedding resin 90 (for example, an epoxy resin), and the resultant is cut with a diamond knife such that the thickness thereof is 500 nm so as to prepare a sample. A cross section of the sample is observed by using an optical microscope or a transmission electron microscope (TEM) so as to measure the porosity of the toner through the image processing. The porosity is calculated by dividing the area of the portions colored with toner (in the exemplary embodiment, cyan, magenta, yellow, and black portions) by the total area of the toner image G, and the obtained value is represented by a percentage.

When the porosity of the toner in the outlet 65 of the continuous paper P is in a range of 20 vol. % to 40 vol. %, a gap is formed between toner particles of the toner image G on continuous paper P, and a path (vaporizing path) through which the carrier oil evaporates and transmits from the continuous paper P is ensured.

In addition, the heating device 60 is configured such that the toner image G on continuous paper P is heated at a temperature which is lower than the melting temperature of the toner. In other words, in the heating device 60, when the temperature of the warm air and the amount of the warm air of the warm air heater 68 are adjusted, the toner image G on continuous paper P is heated at a temperature which is lower than the melting temperature of the toner. In this state, the melting state of the toner image G on continuous paper P is prevented, and the path (vaporizing path) through which the carrier oil evaporates and transmits from the continuous paper P is ensured by the gap formed between the toner particles of the toner image G on continuous paper P. In the exemplary embodiment, the melting temperature of the toner is, for example, in a range of 120° C. to 140° C., and the heating temperature by the heating device 60 is, for example, set to be lower than 120° C.

In the heating device 60, as described above, the continuous paper P is wound onto the heating roller 64 in the range of 180 degrees or more in the circumferential direction of the heating roller 64. With this, in the image forming apparatus 10, as compared with the case where the continuous paper is wound onto the heating roller in a range of degrees lower than 180 degrees in the circumferential direction of the heating roller, the image forming apparatus 10 is configured to be compact as a whole.

The pre-fixing drying unit 58 is provided with the drying device 70 as described above. The drying device 70 is provided at a position where the continuous paper P is wound onto the above-described two feeding rollers 12A and 12B. The feeding rollers 12A and 12B are configured so as to be in contact with the toner image G which is not fixed on the continuous paper P on the downstream side of the heating device 60. Here, the feeding rollers 12A and 12B each are described as an example of the roller. A release layer (for example, a PFA tube) is provided on the surfaces of the feeding rollers 12A and 12B.

The drying device 70 is provided with a box-shaped housing (drying furnace) 72 surrounding a path through which the continuous paper P passes, and the feeding rollers 12A and 12B are disposed in the housing 72. Two slits (not shown) for putting in and out the continuous paper P are formed in the housing 72. In the drying device 70, the inside of the housing 72 is kept at a predetermined temperature by the warm air heater or the infrared lamp which is not shown. The temperature of the inside of the housing 72 is, for example, higher than the temperature of the image forming unit 14, and is kept at a temperature which is equal to or lower than the temperature of the heating source 64B in the heating device 60 and the temperature of the warm air of the warm air heater 68. With this, the continuous paper P is dried by evaporating (removing) the carrier oil in the toner image G and the continuous paper P while the toner image on the continuous paper P passes through the housing 72. At this time, the carrier oil in the toner image G and the continuous paper P is evaporated while preventing the toner image G on continuous paper P from being melted.

The drying device 70 of the exemplary embodiment has, as an example, a configuration in which the warm air at 100° C. is slowly circulated by the warm air heater (not shown), and the wind speed of the surface of the continuous paper P at the time of stop is set to be in a range of 1 to 2 m/s. In the drying device 70, the time for drying is adjusted by changing the feed length of the supplied continuous paper P. Note that, in the drying device 70, the housing 72 may be kept at a predetermined temperature by an infrared lamp instead of the warm air heater.

In the fixing device 80, the heating roller 82 is disposed on such a side that the heating roller 82 is in contact with the toner image G on continuous paper P. The heating roller 82 is provided with a heating source 82B in a tube portion 82A having a cylindrical shape. The heating source 82B is a halogen lamp or the like. The temperature of the heating roller 82 provided by the heating source 82B is, for example, set to be higher than the melting temperature of the toner image G. The pressurizing roller 84 is disposed on the side which is not in contact with the toner image G on continuous paper P. In other words, the pressurizing roller 84 is disposed so as to be in contact with the surface on the side opposite to the surface on which the toner image G on continuous paper P is formed.

When the pressurizing roller 84 is pressed toward the heating roller 82 via the continuous paper P, a nip portion is formed between the heating roller 82 and the pressurizing roller 84. A feeding path is set so as to allow the continuous paper P to pass through the nip portion, and the pressurizing roller 84 and the heating roller 82 rotate following the movement of the continuous paper P.

Actions and Effects

Next, the actions and effects of the image forming apparatus 10 of the first exemplary embodiment will be described.

In the image forming apparatus 10, the toner image G in which colors are superimposed is formed on the continuous paper P by each of the color image forming units 14 as described above. Then, the toner image G on continuous paper P is supplied to the pre-fixing heating unit 56, and the toner image G on continuous paper P is heated by the heating device 60. In the heating device 60, the toner image G on continuous paper P is heated, since the continuous paper P passes through the area in which the continuous paper P is wound onto the heating roller 64 and the warm air is blown between the heating roller 64 and the cover 66 by the warm air heater 68.

In this case, in the heating device 60, the heating is controlled such that the porosity of the toner of the toner image G in the outlet 65 of the continuous paper P is in a range of 20 vol. % to 40 vol. % by adjusting the temperature of the heating source 64B and the temperature and the air volume of the warm air by the warm air heater 68. With this, a gap is formed between toner particles of the toner image G on continuous paper P, and therefore, the carrier easily oil passes between toner particles and evaporates from the continuous paper P.

In addition, in the heating device 60, when the temperature of the warm air and the amount of the warm air of the warm air heater 68 are adjusted, the toner image G on continuous paper P is heated at a temperature which is lower than the melting temperature of the toner. In this state, the melting state of the toner image G on continuous paper P is prevented, namely, the case where the toner image G on continuous paper P is melted to cause the gap between toner particles to be smaller is prevented. In other words, the toner particles are fused to each other while the carrier oil in the continuous paper P is not prevented from evaporating and transmitting. For this reason, a large amount of the carrier oils is likely to evaporate from the continuous paper P through the gaps between the toner particles.

The toner image G on continuous paper P having passed through the heating device 60 is supplied to the drying device 70 of the pre-fixing drying unit 58. In the drying device 70, the temperature of the inside of the housing 72 is kept, for example, at a temperature which is higher than the temperature of the image forming unit 14 and is equal to or lower than the temperature of the heating source 64B in the heating device 60 and the temperature of the warm air of the warm air heater 68. Accordingly, while the toner image on the continuous paper P passes through the housing 72, the carrier oil in the toner image G and the continuous paper P is evaporated and removed, so that the continuous paper P is dried. At this time, the carrier oil in the continuous paper P is evaporated while preventing the toner image G on continuous paper P from being melted, so that the continuous paper P is dried.

In the drying device 70, the toner image G on continuous paper P is in contact with the feeding rollers 12A and 12B which change the direction of the continuous paper P. In this case, the heating is controlled such that the porosity of the toner of the toner image G on continuous paper P is in a range of 20 vol. % to 40 vol. %, and the melting state of the toner image G on continuous paper P is prevented, thereby preventing the toner image G from causing offset on the feeding rollers 12A and 12B.

In addition, the toner image of the continuous paper P is supplied to the fixing unit 16, and the toner image G is fixed on the continuous paper P by the plural fixing devices 80.

In the above-described image forming apparatus 10, the heating is controlled by the heating device 60 such that the porosity of the toner of the toner image G in the outlet 65 of the continuous paper P is in a range of 20 vol. % to 40 vol. %. For this reason, in the image forming apparatus 10, the continuous paper P is dried by the evaporation of the carrier oil in the continuous paper P as compared with the case where the porosity of the toner image on the continuous paper before being fixed is less than 20 vol. %, and the toner image G on continuous paper P is prevented from causing offset on the feeding rollers 12A and 12B as compared with the case where the porosity of the toner image on the continuous paper before being fixed is greater than 40 vol. %. Further, in the image forming apparatus 10, as compared with the case where the porosity of the toner image on the continuous paper before being fixed is greater than 40 vol. %, the toner image G on continuous paper P is prevented from causing offset on the heating roller 82.

In addition, in the image forming apparatus 10, the heating device 60 is configured to perform heating at a temperature which is lower than the melting temperature of the toner. For this reason, in the image forming apparatus 10, as compared with the configuration in which the heating is performed at a temperature which is equal to or higher than the melting temperature of the toner, the continuous paper P is dried by the evaporation of the carrier oil in the continuous paper P.

In addition, in the image forming apparatus 10, the feeding rollers 12A and 12B that guide the continuous paper P and contact with the toner image G which is not fixed on the continuous paper P are provided between the heating device 60 and the fixing device 80. In the image forming apparatus 10, as compared with the case where the porosity of the toner image before being fixed on the recording medium is greater than 40 vol. %, when the toner image G before being fixed on the continuous paper P is in contact with the feeding rollers 12A and 12B, the toner image G on continuous paper P is prevented from causing offset on the feeding rollers 12A and 12B.

In addition, in the image forming apparatus 10, on the drying path, the drying device 70 that dries the continuous paper P by heating or blowing warm air to evaporate the carrier oil in the continuous paper P. For this reason, in the image forming apparatus 10, it is possible to make the drying path or the drying time of the continuous paper P short as compared with the configuration where the drying member for drying the continuous paper is not disposed.

Second Embodiment

Next, an image forming apparatus according to the second exemplary embodiment will be described. Note that, the same components as those of the first exemplary embodiment described above are denoted by the same reference numerals, and the description thereof will not be repeated.

Figure 3:
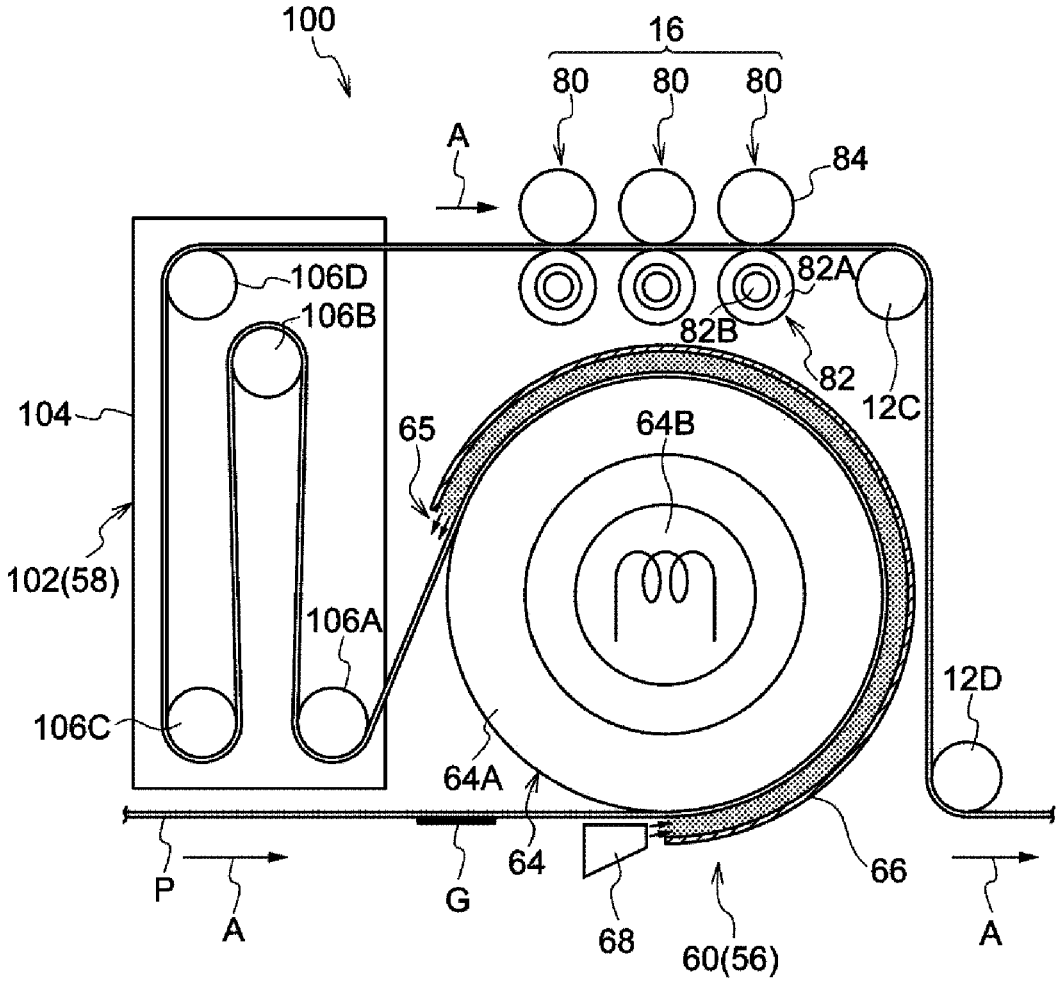
FIG. 3 is a sectional view illustrating a heating device, a drying path, and a fixing device used for an image forming apparatus according to a second exemplary embodiment.

FIG. 3 illustrates components in the vicinity of the pre-fixing drying unit 58 of an image forming apparatus 100 according to the second exemplary embodiment will be described. As illustrated in FIG. 3, in the image forming apparatus 100, a drying device 102 is provided as an example of the drying member in the pre-fixing drying unit 58. The drying device 102 is provided with a housing (drying furnace) 104 which is greater than the housing 72 of the drying device 70 in the first exemplary embodiment. In the housing 104, the four feed rollers 106A, 106B, 106C, and 106D that change the direction of the continuous paper P supplied from the outlet 65 of the heating device 60 are provided. The four feed rollers 106A, 106B, 106C, and 106D are arranged in order from the upstream side to the downstream side of the continuous paper P, and the continuous paper P is wound onto the four feed rollers 106A, 106B, 106C, and 106D. In the exemplary embodiment, the feed rollers 106A and 106C are disposed on one side in the longitudinal direction (the lower side in the exemplary embodiment), and the feed rollers 106B and 106D are disposed on the other side in the longitudinal direction (the upper side in the exemplary embodiment). The toner image G on continuous paper P is configured to be in contact with the feed rollers 106A, 106C, and 106D which constitute an example of the constitution of the rollers.

In the drying device 102, the inside of the housing 104 is kept at a predetermined temperature by the warm air heater or the infrared lamp which is not shown. The drying device 102 has a configuration in which the continuous paper P is dried by evaporating the carrier oil in the continuous paper P at a temperature which is lower than the heating temperature of the heating device 60. In the drying device 102, as compared with the drying device 70 (refer to FIG. 2) of the image forming apparatus 10 according to the first exemplary embodiment, the continuous paper P is wound onto the four feed rollers 106A, 106B, 106C, and 106D, and thus the feed length of the continuous paper P and the drying time becomes longer.

In the above-described image forming apparatus 100, the continuous paper P is dried by evaporating the carrier oil in the continuous paper P as compared with the case where the porosity of the toner image before being fixed on the continuous paper is less than 20 vol. %, and as compared with the case where the porosity of the toner image before being fixed on the continuous paper is greater than 40 vol. %, the toner image G on continuous paper P is prevented from causing offset on the feed rollers 106A, 106C, and 106D.

In addition, in the image forming apparatus 100, it is possible to make the drying path or the drying time of the continuous paper P short as compared with the configuration in which the drying member for drying the continuous paper is not disposed.

Third Embodiment

Next, an image forming apparatus according to the third exemplary embodiment will be described. Note that, the same components as those of the first exemplary embodiment and the second exemplary embodiment described above are denoted by the same reference numerals, and the description thereof will not be repeated.

Figure 4:
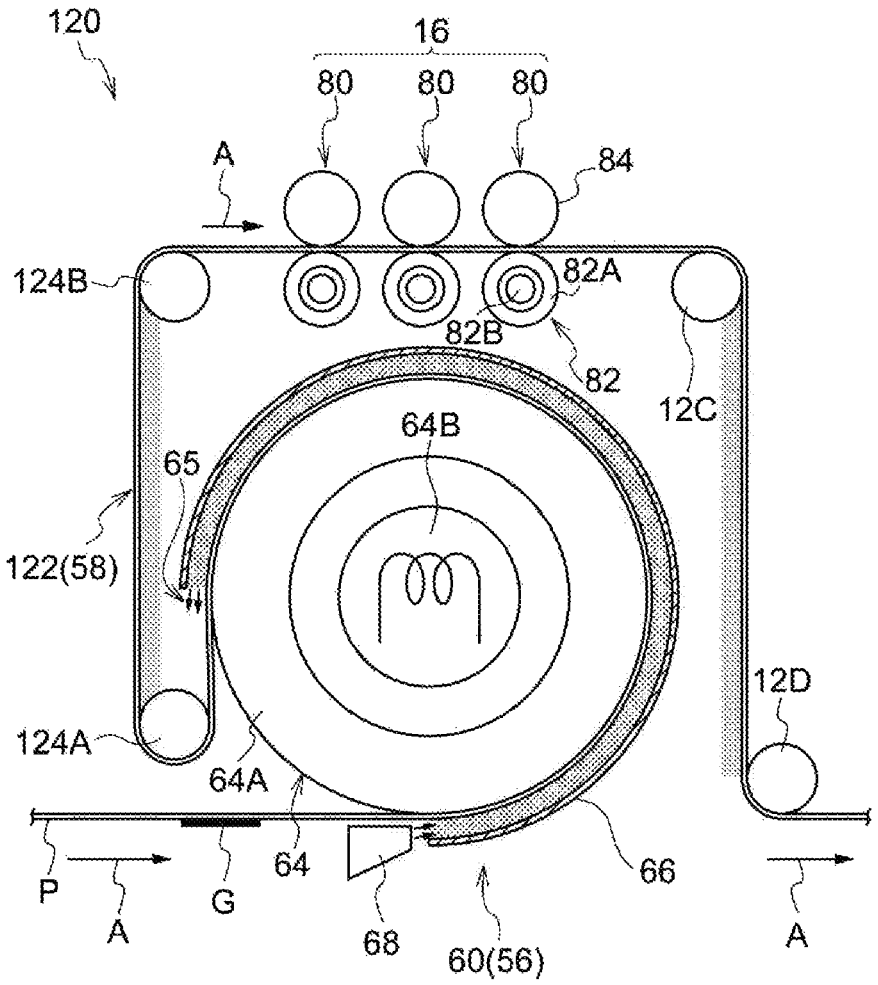
FIG. 4 is a sectional view illustrating a heating device, a drying path, and a fixing device used for an image forming apparatus according to a third exemplary embodiment.

FIG. 4 illustrates components in the vicinity of the pre-fixing drying unit 58 of an image forming apparatus 120 according to the third exemplary embodiment. As illustrated in FIG. 4, the pre-fixing drying unit 58 of the image forming apparatus 120 is set as a drying path 122 on which the continuous paper P is wound onto two feed rollers 124A and 124B. The drying path 122 is configured such that the continuous paper P is sent to the feed roller 124B by changing the direction by the feed roller 124A on the downstream side of the heating device 60. Since the warm air blown out between the cover 66 and the heating roller 64 by the outlet 65 of the heating device 60 flows (circulates) into the drying path 122, the drying path 122 is kept at a temperature which is higher than the temperature of the image forming unit 14 (refer to FIG. 1). In the drying path 122, the continuous paper P is dried by evaporating the carrier oil in the continuous paper P at a temperature which is lower than the heating temperature of the heating device 60. The toner image G on continuous paper P is configured to be in contact with the feed rollers 124A and 124B which each is an example of the roller.

In the above-described image forming apparatus 120, the continuous paper P is dried by evaporating the carrier oil in the continuous paper P as compared with the case where the porosity of the toner image before being fixed on the continuous paper is less than 20 vol. %, and the toner image G on continuous paper P is prevented from causing offset on the feed rollers 124A and 124B as compared with the case where the porosity of the toner image before being fixed on the continuous paper is greater than 40 vol. %.

Note that, in the first to third exemplary embodiments, the configuration of the heating device 60, and the range where the continuous paper P is wound onto the heating roller 64 may be changed.

Further, in the first to third exemplary embodiments, the heating device 60 is configured to heat the toner image G on continuous paper P at the temperature which is lower than the melting temperature of the toner; however, the invention is not limited to the this configuration. For example, the heating device may have a configuration in which the toner image is heated such that the temperature of the toner image in the outlet 65 of the continuous paper P is lower than the melting temperature of the toner. That is, the heating device may have a configuration in which the toner image is heated such that the temperature of the heating source or the like is equal to or higher than the melting temperature of the toner and the temperature of the toner image in the outlet 65 of the continuous paper P of the heating device is less than the melting temperature of the toner.

In addition, the image forming apparatus according to the third exemplary embodiment has a configuration in which the warm air blown out between the cover 66 and the heating roller 64 by the outlet 65 of the heating device 60 flows (circulates) into the drying path 122; however, instead of this configuration, it may have a configuration in which the feed length of the drying path and the drying time are ensured by making the drying path long without circulating the warm air in the drying path.

Further, in the image forming apparatus according to the first exemplary embodiment, the plural image forming units 14 are arranged in the transverse direction; however, the invention is not limited to this configuration. For example, the plural image forming units 14 may be arranged in the longitudinal direction. In addition, the plural image forming units 14 are configured to have four colors; however, the invention is not limited thereto. For example, the image forming units having other colors may be arranged and the number of colors may be changed. Further, in the image forming apparatus, the arrangement of the heating device, the drying path, and the fixing device may be changed in accordance with the change of the arrangement of the plural image forming units 14.

Note that, the invention has been described in detail with respect to specific exemplary embodiments; however, the invention is not limited to such embodiments, and it is obvious for those skilled in the art that various other embodiments are possible within the scope of the invention.

EXAMPLE

Next, an experiment performed for evaluating the porosity of the toner layer and the drying properties by changing the temperature of the heating device and the drying time will be described. In the experiment, an image is formed by using the image forming apparatus 10 as illustrated in FIGS. 1 and 2.

Heating Device

In the heating device 60, the aluminum heating roller 64 having a diameter of 300 mm is used, and the continuous paper P is in contact with the heating roller 64 in a range of (at an angle of) 250 degree. The contact length of the circumferential direction of the heating roller 64 of the continuous paper P is 650 mm. The warm air at 100° C. is blown between the heating roller 64 and the cover 66 at a wind speed of 20 m/s by the warm air heater 68. The heating temperature (preheating temperature) by the heating roller 64 is changed in a range of 60° C. to 130° C. in a stepwise manner (refer to FIG. 6).

Drying Device

In the housing (drying furnace) 72 of the drying device 70, the warm air at 100° C. is gently circulated (the surface wind speed of the continuous paper P at the time of stop is in a range of 1 to 2 m/s). The surfaces of the feeding rollers 12A and 12B are covered with a PFA tube (manufactured by GUNZE LIMITED).

Liquid Developer

A toner including a polyester colored resin having a volume average particle diameter of 1.7 μm is dispersed in ISOPAR-L (manufactured by Exxon Mobil Corporation). The solid content concentration of the toner in liquid developer is 20 wt %.

Recording Medium

As the continuous paper P, a label manufactured by LINTEC Corporation (Gross PW8K) is used.

Sample

An image having a 50 mm square size and having two-color with a density of 100% is printed on the continuous paper P. The toner amount after image forming is 2.8 $g/m^2$. The amount of the carrier oil of the continuous paper P and the toner image after image forming (before the heating device 60) is 4.0 $g/m^2$, and the value of this amount is set as an initial oil amount.

Experiment Method

The feeding speed of the continuous paper P is set to be 650 mm/sec, and the contact time of the continuous paper P and the heating roller 64 of the heating device 60 is fixed to be 1.0 s. The porosity of the sample immediately after the outlet 65 of the heating device 60 is measured while changing the preheating temperature by the heating device 60 in a range of 60° C. to 130° C. in a stepwise manner. The drying time of the drying device 70, that is, the passing time in the housing (heating furnace) 72 is set as 1 s, 2 s, and 3 s, respectively, and the followings (1) to (3) are evaluated.

(1) The amount of the carrier oil of the sample immediately after passing through the drying device 70 is measured.

(2) The presence or absence of the toner on the feeding rollers 12A and 12B being in contact with the image surface of the toner image is measured. Specifically, wiping off the surface of the feeding rollers 12A and 12B, the presence or absence of the toner is confirmed with a loupe.

(3) The presence or absence of the toner in a white paper portion of the continuous paper P on the downstream of the image portion of the toner image is confirmed with the loupe.

The value obtained by the above (1) is set as a residual oil amount, and when the residual oil is 0 at the drying time 3 s, the drying properties are evaluated as "AA", and when the residual oil is not 0 at the drying time 3 s, the drying properties are evaluated as "BB". Further, in a case where it is not possible to confirm the toner in both of the above (2) and (3), the offset is evaluated as "AA". Also, if the toner is confirmed at one of the drying times 1 s, 2 s and 3 s, the offset is evaluated as "BB".

Taking-Out of Sample

After the sample passes through the heating device 60 (or after passing through the drying device 70), the image forming apparatus 10 is emergently stopped, and an aluminum block at room temperature (25° C.) is allowed to be in contact with a sample patch portion (image portion) for 2 s to perform cooling. After cooling, the sample is cut out. Here, the cooling is performed for preventing the progress of melting and drying of the toner due to the preheating of the continuous paper P. The porosity of the toner is calculated by the measuring method as illustrated in FIG. 5 as described above.

Figure 6:
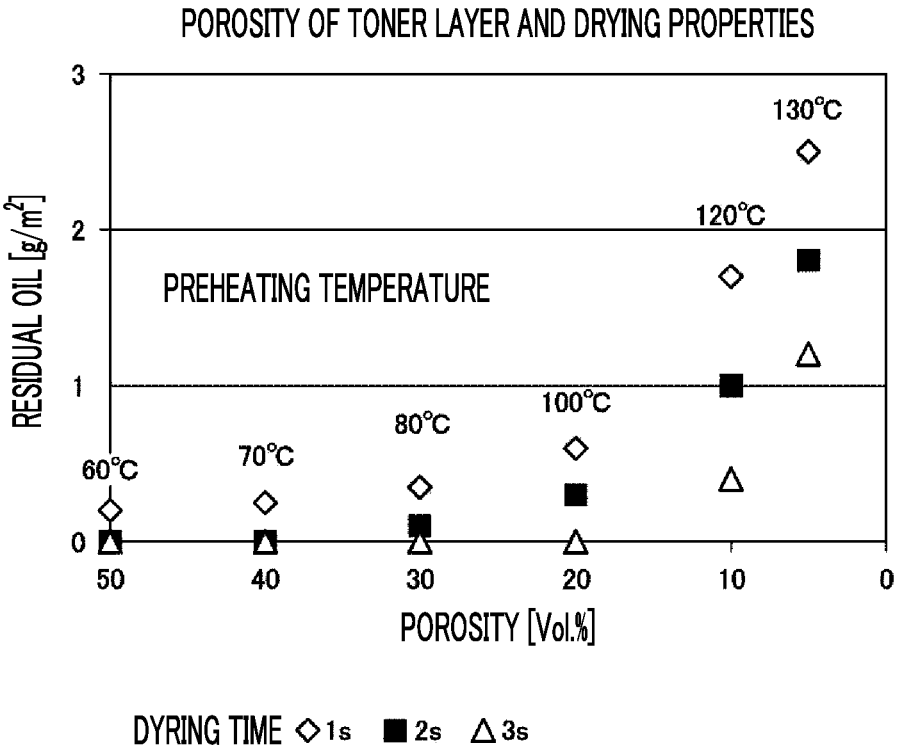
FIG. 6 is a graph illustrating a relationship between the porosity of a toner layer and a residual oil in a case where a heating temperature of the heating device and a drying time of a drying path are changed.
Figure 7:
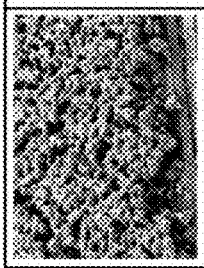
FIG. 7 is a diagram illustrating an evaluation result of the drying properties and offset in a case of the different porosity of the toner layer.
Figure 7:
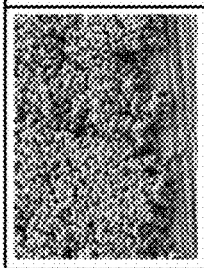
Figure 7:
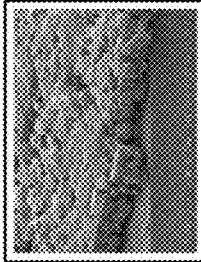
Figure 7:
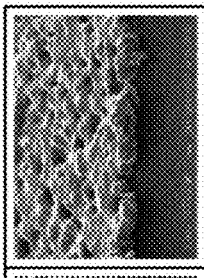

FIG. 6 is a graph illustrating a relationship between the residual oil and the porosity of the toner in a case where the preheating temperature by the heating device 60 and the drying time by the drying device 70 are changed. As illustrated in FIG. 6, it is understood that when the porosity of the toner is equal to or greater than 20 vol. %, the amount of the residual oil is small. In addition, FIG. 7 is a diagram illustrating an evaluation result of the drying properties with respect to the porosity of the toner and the toner offset. As illustrated in FIG. 7, it is understood that in a case where the porosity of the toner is in a range of 20 vol. % to 40 vol. %, the drying properties become excellent, and the toner offset does not occur.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a fixing device that fixes a toner image which is developed with a liquid developer containing a toner and a volatile carrier oil on a recording medium;

a heating device that is disposed on an upstream side of the fixing device in a feed direction of the recording medium, and heats the toner image on the recording medium in a non-contact manner, in which heating is controlled such that a porosity of the toner image on the recording medium in an outlet of the heating device is in a range of 20% by volume to 40% by volume; and a drying path that is disposed between the heating device and the fixing device in the feed direction of the recording medium, and dries the recording medium by evaporating the carrier oil in the recording medium.

2. The image forming apparatus according to claim 1, wherein the heating device is configured to heat the toner image such that a temperature of the toner image on the recording medium in an outlet of the heating device is lower than a melting temperature of the toner.

3. The image forming apparatus according to claim 2, wherein the heating device is configured to heat the toner image at a temperature which is lower than the melting temperature of the toner.

4. The image forming apparatus according to claim 3, wherein the heating device includes a heating roller which is in contact with a surface of the recording medium on which the toner image is not developed, and a blowing unit that blows warm air to the recording medium.

5. The image forming apparatus according to claim 4, wherein the recording medium is configured to be wound onto the heating roller in an angle range of 180 degrees or more in a circumferential direction of the heating roller.

6. The image forming apparatus according to claim 3, wherein a roller that guides the recording medium and is in contact with the toner image on the recording medium is provided between the heating device and the fixing device.

7. The image forming apparatus according to claim 3, wherein on the drying path, a drying member that dries the recording medium by heating or blowing warm air to evaporate the carrier oil in the recording medium is disposed.

8. The image forming apparatus according to claim 2, wherein the heating device includes a heating roller which is in contact with a surface of the recording medium on which the toner image is not developed, and a blowing unit that blows warm air to the recording medium.

9. The image forming apparatus according to claim 8, wherein the recording medium is configured to be wound onto the heating roller in an angle range of 180 degrees or more in a circumferential direction of the heating roller.

10. The image forming apparatus according to claim 2, wherein a roller that guides the recording medium and is in contact with the toner image on the recording medium is provided between the heating device and the fixing device.

11. The image forming apparatus according to claim 2, wherein on the drying path, a drying member that dries the recording medium by heating or blowing warm air to evaporate the carrier oil in the recording medium is disposed.

12. The image forming apparatus according to claim 1, wherein the heating device is configured to heat the toner image at a temperature which is lower than the melting temperature of the toner.

13. The image forming apparatus according to claim 12, wherein the heating device includes a heating roller which is in contact with a surface of the recording medium on which the toner image is not developed, and a blowing unit that blows warm air to the recording medium.

14. The image forming apparatus according to claim 13, wherein the recording medium is configured to be wound onto the heating roller in an angle range of 180 degrees or more in a circumferential direction of the heating roller.

15. The image forming apparatus according to claim 12, wherein a roller that guides the recording medium and is in contact with the toner image on the recording medium is provided between the heating device and the fixing device.

16. The image forming apparatus according to claim 12, wherein on the drying path, a drying member that dries the recording medium by heating or blowing warm air to evaporate the carrier oil in the recording medium is disposed.

17. The image forming apparatus according to claim 1, wherein the heating device includes a heating roller which is in contact with a surface of the recording medium on which the toner image is not developed, and a blowing unit that blows warm air to the recording medium.

18. The image forming apparatus according to claim 17, wherein the recording medium is configured to be wound onto the heating roller in an angle range of 180 degrees or more in a circumferential direction of the heating roller.

19. The image forming apparatus according to claim 1, wherein a roller that guides the recording medium and is in contact with the toner image on the recording medium is provided between the heating device and the fixing device.

20. The image forming apparatus according to claim 1, wherein on the drying path, a drying member that dries the recording medium by heating or blowing warm air to evaporate the carrier oil in the recording medium is disposed.

* * * * *